US009835191B1

(12) United States Patent
Chen

(10) Patent No.: US 9,835,191 B1
(45) Date of Patent: Dec. 5, 2017

(54) CHAIR FOOTREST RING POSITIONING STRUCTURE

(71) Applicant: Jia Xie Enterprise Co., Ltd., Tainan (TW)

(72) Inventor: Jun Chen, Tainan (TW)

(73) Assignee: Jia Xie Enterprise Co., Ltd., Tainan (TW)

( * ) Notice: Subject to any disclaimer, the term of this patent is extended or adjusted under 35 U.S.C. 154(b) by 0 days.

(21) Appl. No.: 15/367,234

(22) Filed: Dec. 2, 2016

(51) Int. Cl.
*F16B 12/10* (2006.01)
*A47C 7/00* (2006.01)
*A47C 7/50* (2006.01)

(52) U.S. Cl.
CPC ..... *F16B 12/10* (2013.01); *A47C 7/004* (2013.01); *A47C 7/50* (2013.01)

(58) Field of Classification Search
CPC ..... F16B 12/10; A47C 7/004; A47C 7/50
USPC ..... 297/423.25
See application file for complete search history.

(56) References Cited

U.S. PATENT DOCUMENTS 5,492,430 A * 2/1996 Jones ..... F16B 7/149 248/188.5
7,387,343 B1 * 6/2008 Hsieh ..... A47C 7/004 248/230.2
8,991,928 B2 * 3/2015 Hsieh ..... A47C 7/004 297/344.19
9,220,346 B1 * 12/2015 Wu ..... A47C 7/506

* cited by examiner

*Primary Examiner* — Anthony D Barfield
(74) *Attorney, Agent, or Firm* — Alan D. Kamrath; Kamrath IP Lawfirm, P.A.

(57) ABSTRACT

A chair footrest ring positioning structure includes a guide region tilting downward and concavely disposed on an outer surface of any one side of the lower segment of the tightening case, one or more anti-slip pads fixed inside an internal space of the tightening case, one or more grooves concavely disposed at a periphery of the tightening case, to facilitate insertion of a middle pipe of the chair, and a sleeve corresponding in shape to the middle of the footrest ring fitted around the tightening case. One or more bumps extending from an inner side of the sleeve are inserted into the grooves of the tightening case, respectively. When the middle pipe is rotated to move the tightening case by a predetermined distance, the guide region undergoes a displacement to drive insertion of the bumps, thereby pushing the tightening case inward.

1 Claim, 8 Drawing Sheets

CHAIR FOOTREST RING POSITIONING STRUCTURE

BACKGROUND OF THE INVENTION

1. Field of the Invention

The present invention relates to a chair footrest ring positioning structure characterized in that a guide region tilts downward and is concavely disposed on the outer surface of any one side of the lower segment of the tightening case, and on which anti-slip pads are fixed therein and grooves are concavely disposed peripherally thereon. Thus, bumps extending from the inner side of the sleeve corresponding in shape to the middle of the footrest ring and fitted around the tightening case are inserted into the grooves of the tightening case, and the middle pipe of the chair is rotated to move the tightening case by a predetermined distance and thereby causing the guide region to undergo a displacement to drive the insertion of the bumps, to effectuate dynamic adjustment and thus achieve a predetermined degree of tightness.

2. Description of the Prior Art

A conventional footrest ring coupled to a tall chair and positioned at a predetermined height is characterized in that a tightening component of appropriate tightness is disposed at a predetermined segment of a middle pipe of the chair. Thus, the tightening component allows a sleeve to be held in the middle of the footrest ring, and the middle of the footrest ring is of a predetermined width. Hence, the footrest ring is confined to the predetermined segment of the middle pipe and thus is convenient to place a foot on.

Although the footrest ring in operation is tightened, it is predisposed to tightness inadequacy after long use.

In view of the aforesaid drawback of the prior art, the present invention provides a chair footrest ring positioning structure characterized in that a guide region tilts downward and is concavely disposed on the outer surface of any one side of the lower segment of the tightening case, and on which anti-slip pads are fixed therein and grooves are concavely disposed peripherally thereon. Thus, bumps extending from the inner side of the sleeve corresponding in shape to the middle of the footrest ring and fitted around the tightening case are inserted into the grooves of the tightening case, and the middle pipe of the chair is rotated to move the tightening case by a predetermined distance and thereby causing the guide region to undergo a displacement to drive the insertion of the bumps, to effectuate dynamic adjustment and thus achieve a predetermined degree of tightness.

SUMMARY OF THE INVENTION

Considering that a conventional footrest ring coupled to a predetermined segment of a chair is predisposed to tightness inadequacy because of a small outer diameter of a middle pipe of the chair, the present invention aims to improve the conventional footrest ring so that a guide region tilting downward is concavely disposed on the outer surface of any one side of the lower segment of the tightening case, and on which one or more anti-slip pads are fixed therein and one or more grooves are concavely disposed peripherally thereon. Thus, one or more bumps extending from the inner side of the sleeve corresponding in shape to the middle of the footrest ring and fitted around the tightening case are inserted into the grooves of the tightening case, and the middle pipe of the chair is rotated to move the tightening case by a predetermined distance and thereby causing the guide region to undergo a displacement to drive the insertion of the bumps, thereby pushing the tightening case inward to effectuate dynamic adjustment and thus achieve a predetermined degree of tightness.

It is an objective of the present invention to provide a footrest ring coupled to a predetermined segment of a middle pipe of a chair, characterized in that a chair footrest ring positioning structure is subjected to a position limitation with enhanced tightening. The footrest ring positioning structure comprises a tightening case, at least one anti-slip pad, and a footrest ring. One or more grooves are concavely disposed on the periphery of the tightening case and correspond in position to one or more grooves concavely disposed on each anti-slip pad fixed inside an internal space of the tightening case, respectively. The advantageous technical features of the chair footrest ring positioning structure are as follows: a guide region tilting downward is concavely disposed on the outer surface of any one side of the lower segment of the tightening case, and on which one or more anti-slip pads are fixed therein and one or more grooves are concavely disposed peripherally thereon, to guide the insertion of the middle pipe of the chair; a sleeve corresponding in shape to the middle of the footrest ring is fitted around the tightening case; and one or more bumps extending from the inner side of the sleeve are inserted into the grooves of the tightening case. When the middle pipe of the chair is rotated to move the tightening case by a predetermined distance, the guide region undergoes a displacement to drive the insertion of the bumps, thereby pushing the tightening case inward to effectuate dynamic adjustment and thus achieve a predetermined degree of tightness.

Another objective of the present invention is that a guide region tilting downward is concavely disposed on the lower segment of the tightening case and positioned proximate to each groove, and the depth reached by the guide region decreases along the groove. Hence, the middle pipe of the chair is rotated by a larger angle to move the tightening case by a longer distance and thereby drives the insertion of the bumps extending from the inner side of the sleeve, thereby pushing the tightening case inward harder to achieve a higher degree of tightness.

DETAILED DESCRIPTION OF THE EMBODIMENT OF THE INVENTION

Figure 2:
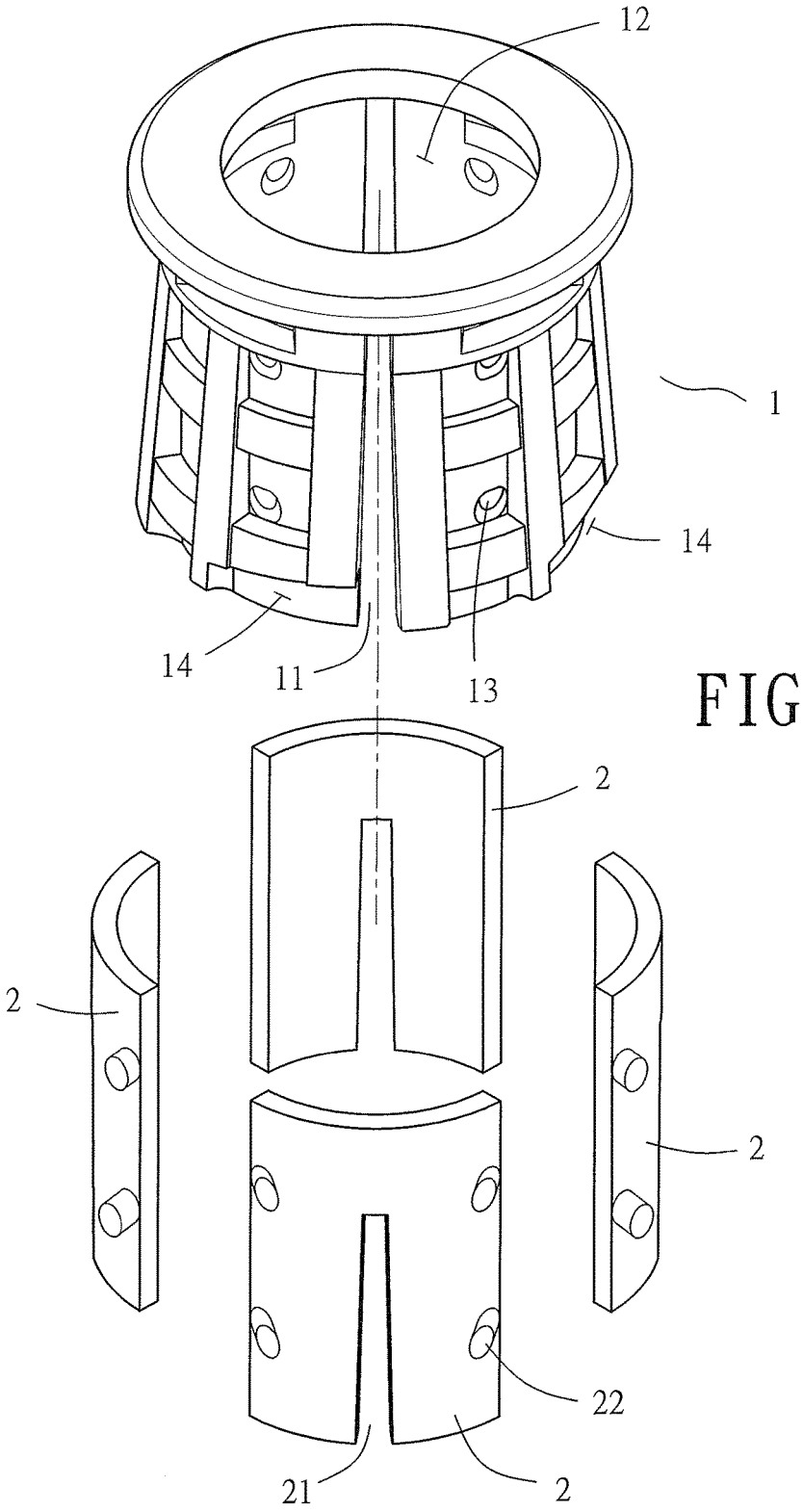
FIG. 2 is an exploded view of the tightening case and related components of the present invention.
Figure 3:
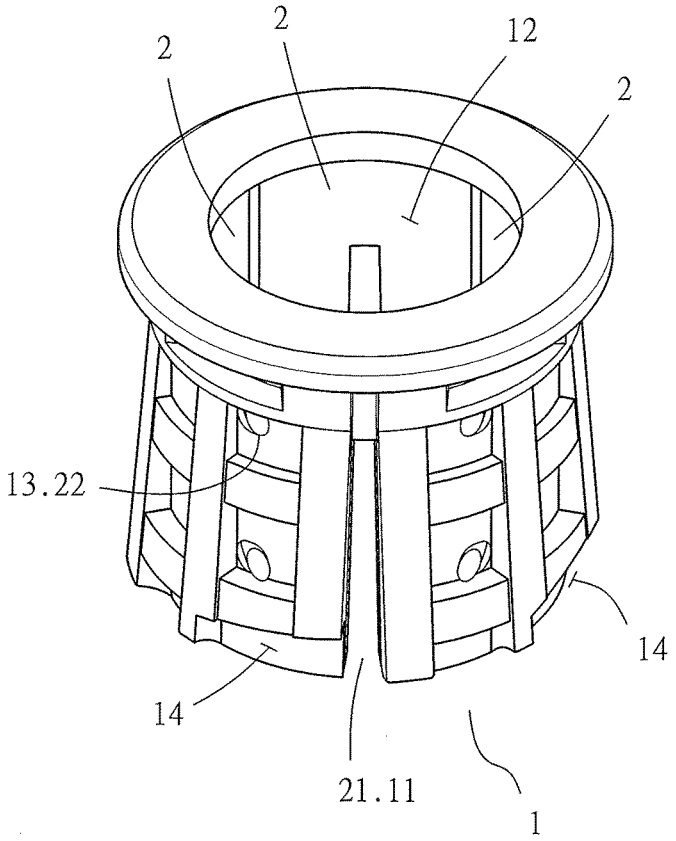
FIG. 3 is a perspective view of the tightening case and related components put together according to the present invention.
Figure 4:
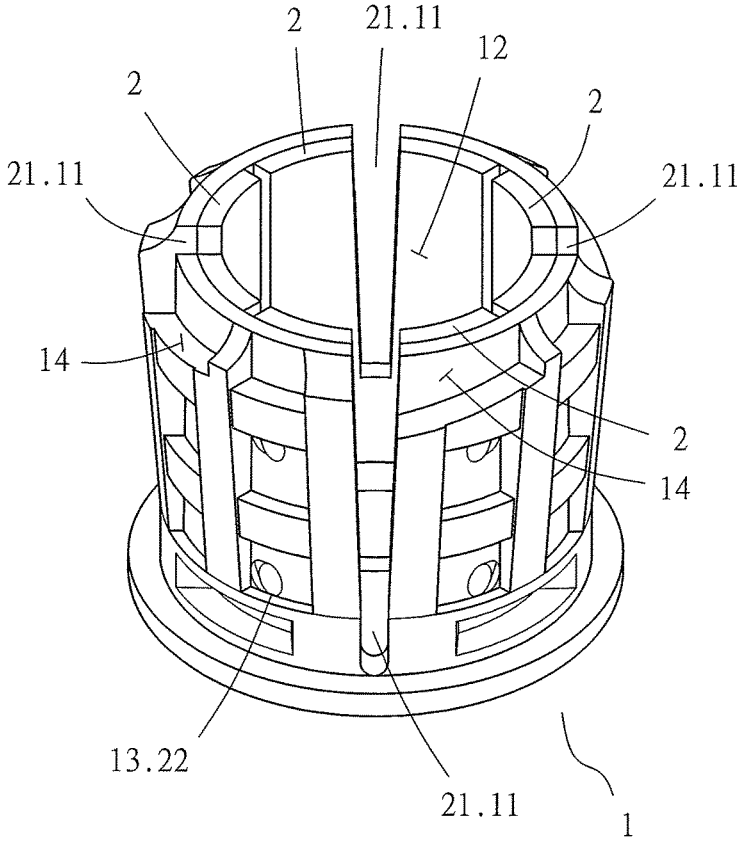
FIG. 4 is a rear perspective view of the tightening case and related components put together according to the present invention.
Figure 5:
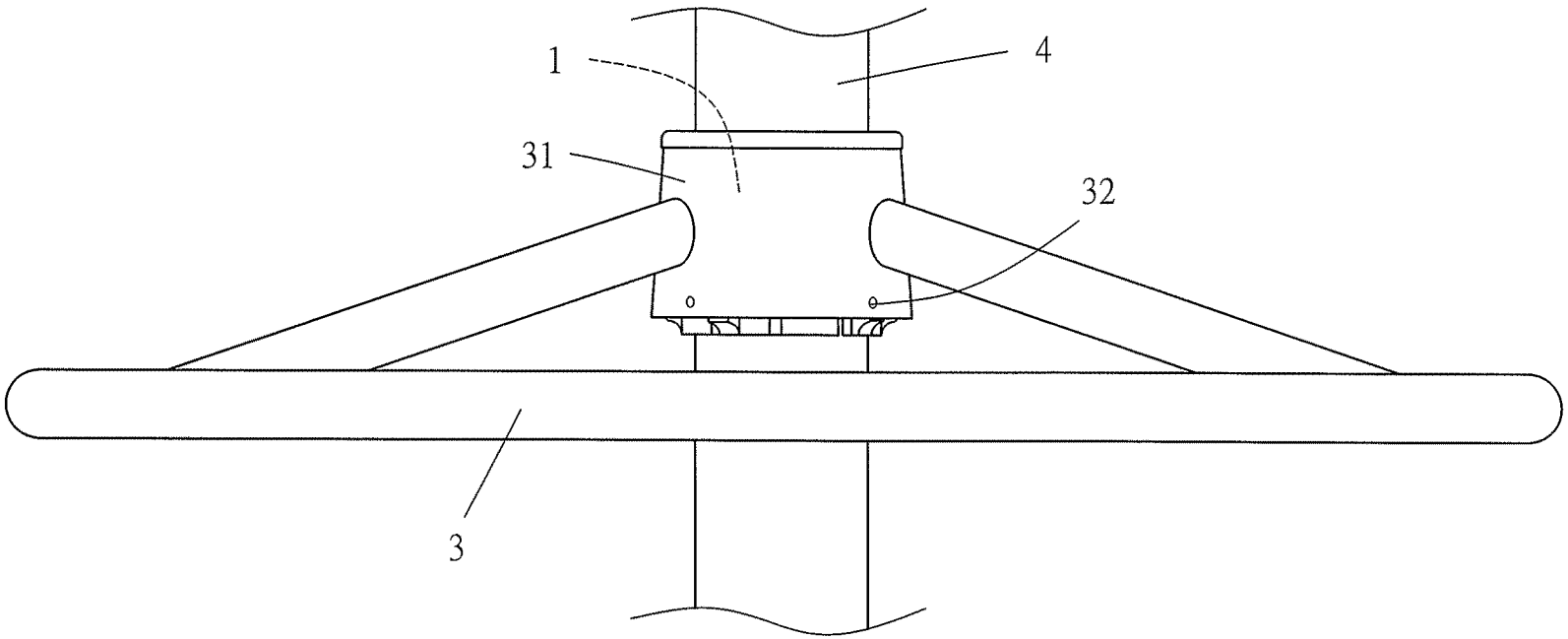
FIG. 5 is a front view of the tightening case inserted into a sleeve corresponding in shape to the middle of a footrest ring according to the present invention.

The present invention provides a chair footrest ring positioning structure as shown in FIG. 2 and FIG. 5. According to the present invention, a footrest ring 3 is coupled to a predetermined segment of a middle pipe 4 of a chair. To impose a position limitation with enhanced tightening upon the chair footrest ring positioning structure, the chair footrest ring positioning structure comprises a tightening case 1, at least an anti-slip pad 2, and a footrest ring 3. One or more grooves 11 are concavely disposed on the periphery of the tightening case 1 and correspond in position to one or more grooves 21 concavely disposed on each anti-slip pad 2 fixed inside an internal space 12 of the tightening case 1, respectively, as shown in FIG. 3 and FIG. 4. One or more holes 13 are disposed between two grooves 11 of the tightening case 1 to a predetermined extent, so that bumps 22 extending from related parts of the anti-slip pads 2 fixed inside the internal space 12 of the tightening case 1 are inserted into the holes 13, respectively. The aforesaid components and arrangement thereof are attributed to the prior art and thus are not regarded as claimed technical features of the present invention.

Figure 1:
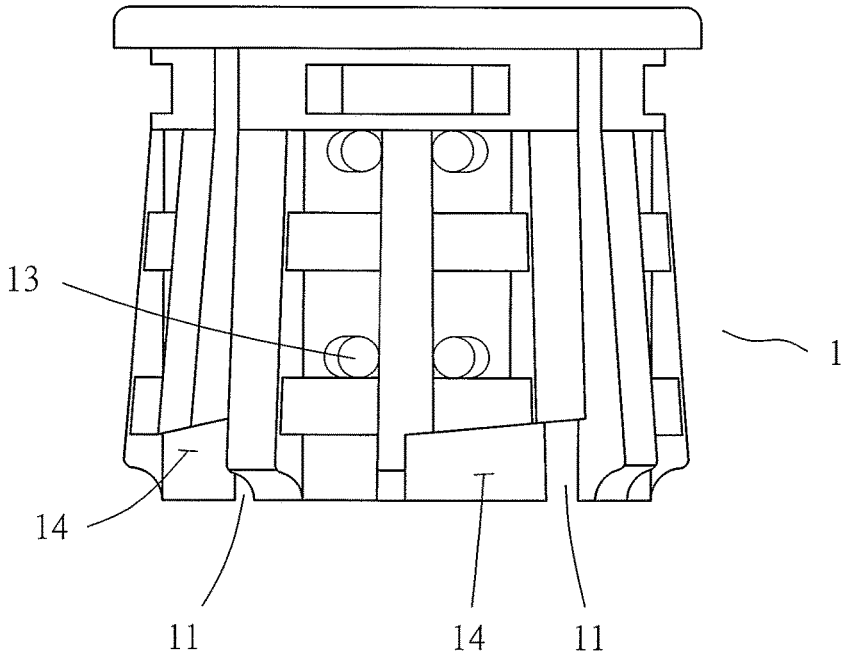
FIG. 1 is a front view of a tightening case of the present invention.
Figure 6:
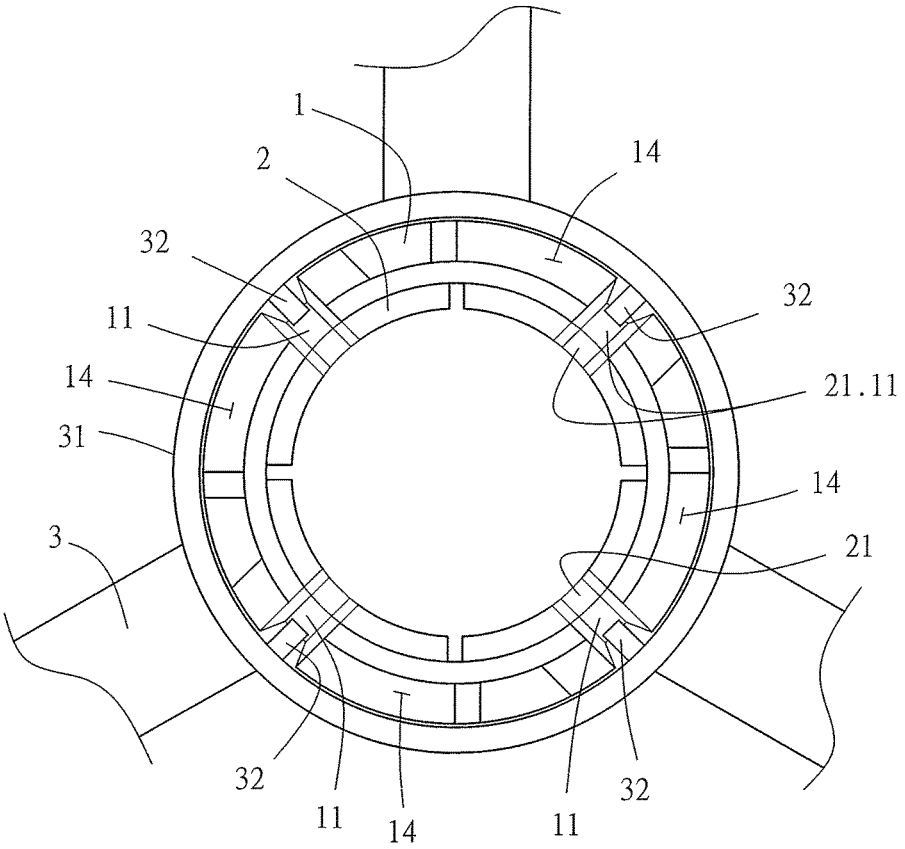
FIG. 6 is a top cross-sectional view of the tightening case inserted into a sleeve corresponding in shape to the middle of the footrest ring according to the present invention.
Figure 7:
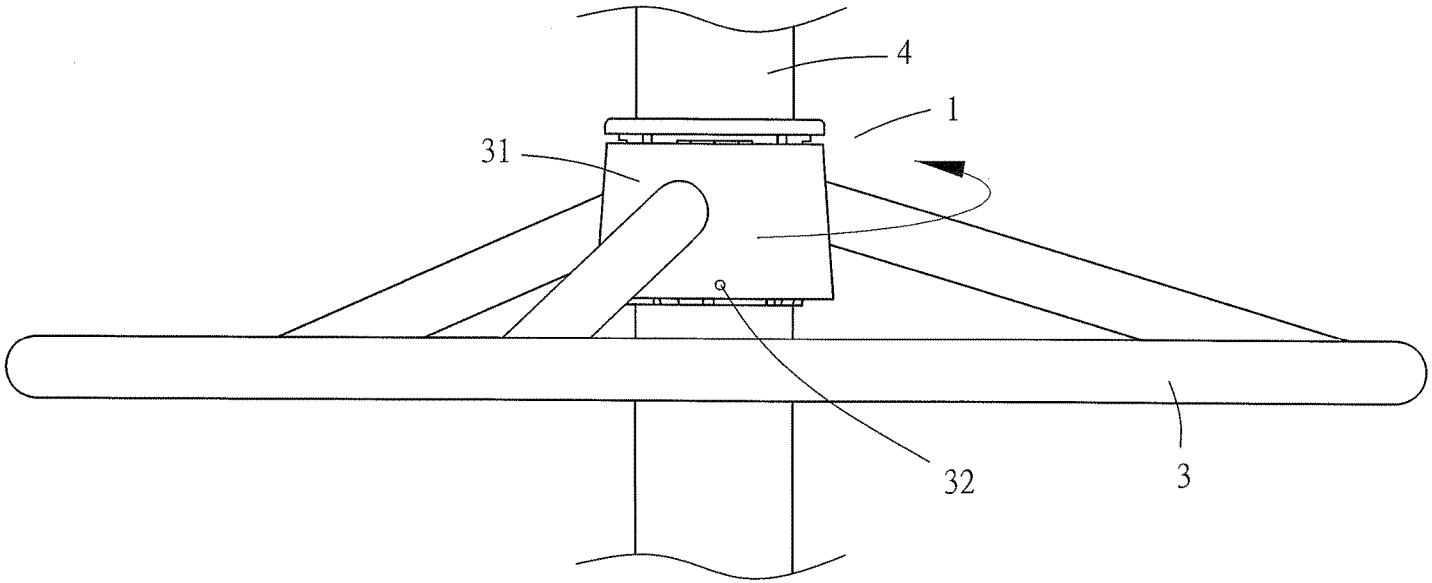
FIG. 7 is a schematic view of how a middle pipe of the chair is rotated to move the tightening case according to the present invention.
Figure 8:
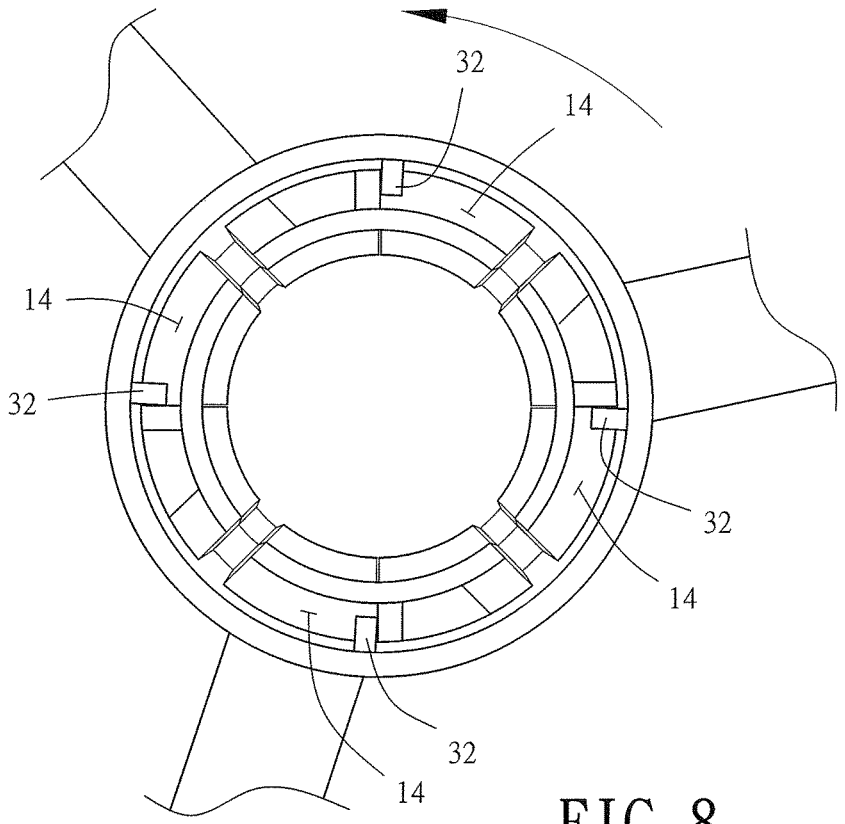
FIG. 8 is a top cross-sectional view of how a middle pipe of the chair is rotated to move the tightening case according to the present invention.

The distinguishing technical features of the present invention, which distinguish the present invention from the prior art, are described below. A guide region 14 tilting downward is concavely disposed on the outer surface of any one side of the lower segment of the tightening case 1. One or more anti-slip pads 2 are fixed inside the internal space 12 of the tightening case 1, and one or more grooves 11 are concavely disposed at a periphery of the tightening case 1 (as shown in FIG. 1, FIG. 2), to facilitate the insertion of the middle pipe 4 of the chair (as shown in FIG. 5). A sleeve 31 corresponding in shape to the middle of the footrest ring 3 is fitted around the tightening case 1. One or more bumps 32 extending from the inner side of the sleeve 31 are inserted into the grooves 11, 21 of the tightening case 1 (as shown in FIG. 6), respectively. When the middle pipe 4 of the chair is rotated to move the tightening case 1 by a predetermined distance (as shown in FIG. 7), the guide region 14 undergoes a displacement to drive the insertion of the bumps 32 (as shown in FIG. 8), thereby pushing the tightening case 1 inward to effectuate dynamic adjustment and thus achieve a predetermined degree of tightness.

What is claimed is:

1. A chair footrest ring positioning structure, subjected to position limitation with enhanced tightening, with a footrest ring coupled to a predetermined segment of a middle pipe of a chair, comprising a tightening case, at least one anti-slip pad, and a sleeve, with the tightening case including an upper segment and a lower segment spaced below the upper segment along the middle pipe of the chair, wherein one or more grooves are concavely disposed on a periphery of the upper segment of the tightening case and correspond in position to one or more grooves concavely disposed on each anti-slip pad fixed inside an internal space of the tightening case, respectively, wherein the lower segment is radially spaced outwardly of the upper segment; wherein a guide region tilting downward is concavely disposed on an outer surface of a side of the lower segment of the tightening case, wherein the sleeve corresponding in shape to the footrest ring is fitted around the tightening case, wherein one or more bumps extending from an inner side of the sleeve are inserted into the guide region of the tightening case, and wherein when the middle pipe of the chair is rotated to move the tightening case by a predetermined distance, the guide region undergoes a displacement to drive insertion of the bumps, thereby pushing the tightening case inward to effectuate dynamic adjustment and thus achieve a predetermined degree of tightness.

* * * * *